United States Patent [19]

Cunningham

[11] 4,050,719

[45] Sept. 27, 1977

[54] COLOR CODED INDEXING SYSTEM

[76] Inventor: Walter F. Cunningham, 183 W. Walnut Ave., Des Plaines, Ill. 60016

[21] Appl. No.: 717,164

[22] Filed: Aug. 24, 1976

[51] Int. Cl.[2] ..... B41F 21/00

[52] U.S. Cl. ..... 283/36; 40/23 A

[58] Field of Search ..... 283/36–40; 40/23 A, 359, 360

[56] References Cited

U.S. PATENT DOCUMENTS

| | | | |
|---|---|---|---|
| 3,303,080 | 2/1967 | Aguilera | 283/36 X |
| 3,937,493 | 2/1976 | Fasbender | 283/41 |

FOREIGN PATENT DOCUMENTS

| | | | |
|---|---|---|---|
| 1,188,458 | 4/1970 | Canada | 283/37 |
| 1,964,132 | 6/1971 | Germany | 283/37 |

*Primary Examiner*—Stephen C. Pellegrino

*Attorney, Agent, or Firm*—McCaleb, Lucas & Brugman

[57] ABSTRACT

A color coded indexing system to facilitate filing and retrieval of documents comprising two 10-position digital bars spaced longitudinally from each other on each opposed surface of an edge portion of each document and each successively displaying in its 10 positions the numerals 0–9, with those on the obverse surface closely adjacent the document edge and those on the reverse surface offset inwardly from the edge; and 10 sets of separable color coded single digit tabs with each set having a different color and displaying one of the digits 0–9 in two columns, the righthand column being closely adjacent the longitudinal center line of the strip and the lefthand column being offset laterally from that center line, and transparent windows to the right of each digit, each set being made up of a backing strip of release paper and a strip of transparent film having a coating of pressure sensitive adhesive on its under surface mounted on the backing strip and transversely cut through to the backing strip to provide a plurality of individually separable tabs; whereby adhering selected tabs over the proper digital positions of the bars and the space between the bars will transform the single digit tabs over the bars into double digit tabs to provide proper identification of the particular number of any document, the colors of the tabs over the bars identifying the ten thousands and tens digits, the color of the tab between the bars identifying the hundreds digit, and the digital positions of the tabs over the bars identifying the thousands and units digits of the document number, and proper filling of documents so identified will provide a color coded set position pattern for any desired filing system.

10 Claims, 7 Drawing Figures

END VIEW ISOMETRIC OF FIG. 1
25 FOLDERS FILED
STRAIGHT NUMERICAL FILED
#s 239.90 TO 24014

10,000's 1000's 100's 10's UNITS
2 3 9 9 0
COLOR POSITION COLOR COLOR POSITION

FILED: COLOR(NO) IN POSITION

TERMINAL DIGIT FILED
#s 1,234,567 TO 1,236,967

COLOR CODED INDEXING SYSTEM

BACKGROUND OF THE INVENTION

1. Field of the invention

This invention relates generally to index filing and retrieval of documents, and more particularly to numerical color coding of documents by means of two 10-position digital bars spaced from each other longitudinally on the documents and not more than three single digit tabs selected from ten sets of color coded tabs, each set having a different color and displaying one of the numerals 0–9 and a transparent portion adjacent to and aligned with each numeral, to provide proper identification of the number of any document with no two alike in 99,999, the proper filing of documents so identified establishing a color coded set position pattern for any desired filing system.

2. Description of the Prior Art

One of the known systems using color coding requires a differently colored folder or document for each of the 10 digits, with the proper color for any document number being determined by the first number of the secondary digits thereof. Each document has two longitudinally spaced 10-position digital bars with the numbers 0–9 printed successively along an edge, and the operator or file clerk blocks out or fills in with a black marking pen the space on the bottom bar having the digit thereon corresponding to the last digit of the document number and the space on the top bar corresponding to the next to the last digit in that number. All documents having numbers with the same two primary or terminal digits are placed in the same section of the files as determined by the first numeral of the secondary digits of the document number. Thus, each section contains only folders or documents of the same color, i.e., those having the same thousands digit in their numbers. The approximate position of a document within its section is determined by the hundreds digit in its number, it being placed in the appropriate one-tenth of that section. This makes for chance filing by document color only and the system cannot be changed for large or small files between active (usually terminal digits), semi-active (usually hundreds) or straight numeric. The colored folders or documents are more costly than plain manila folders, are bulky to stock and greatly increase the problems of maintaining satisfactory inventories. In automated files that hold 10,000 folders per section, the danger exists that a document will be put in the wrong 10,000 section. Misfiles have proved to be common, and if it were attempted to use color tabs in some way, they would blend into the colors of the folders. Further, that system requires the use of additional file guides.

That system has been varied to enable the use of plain manila folders by applying to an edge thereof two ink bars or blocks, usually 1 to 2 inches in length, in the proper one of 10 different colors for the digits 0–9, respectively, with the top bar representing the first numeral and the bottom bar representing the second or units numeral of the primary or terminal digits of the document number. However, that forms in the file only a straight alternating pattern of color blocks which is the same throughout the whole file and presents a mass of colors which makes it harder to spot or retrieve if there is a misfile. Blocks are sometimes added for each digit making five needed tabs to reach 99,999 with the mass of colors forming a straight blocked color pattern.

SUMMARY OF THE INVENTION

This invention results in a completely and easily readable color coded set position pattern in the file that can be used in any desired filing system, i.e., straight numerical, alpha-numeric, terminal, middle or tertiary digits, without requiring differently colored folders or documents or any filing guides. This is accomplished by using the same plain document throughout, such as a manila folder, having two 10-position digital bars spaced longitudinally from each other adjacent an edge thereof and each successively displaying in its 10 positions the numerals 0–9, and ten sets of color coded single digit tabs with each set displaying one of the numerals 0–9 and having a different color, and each tab having a transparent portion or window adjacent to and aligned with the numeral thereon. The proper identification of the particular number of any document may be effected by adhering selected such tabs over and between the bars, the window on those tabs over the bars displaying the associated numeral on the bar to transform the single digit tab into a double digit tab, so that only 10 instead of 100 different tabs are required.

With the proper tabs on each document, that on the bottom bar will display the terminal or tens and units digits, the one in the space between the bars will show the hundreds digit and that on the upper bar will display the thousands and ten thousands digits of the number which is unique to each document. Thus, with this example of using a maximum of three tabs for each document, there will be no two alike in 99,999.

And the invention contemplates display of the proper number on both sides of the document by printing the digital bars on both sides, with the numerals on the obverse side close to the edge and those on the reverse side offset inwardly from the edge, and likewise offsetting the windows on the righthand side of the tabs from their tab-dividing center lines and positioning the windows on their lefthand sides close to the center lines. Then adhering the left half of a tab properly over a digital bar with the tab center line along the edge of the document and folding the tab on its center line to adhere its right half to the reverse surface of the document will superpose each window over a digital bar numeral to display the same double digit number on both sides of the document.

DESCRIPTION OF THE PREFERRED EMBODIMENT

Figure 1:
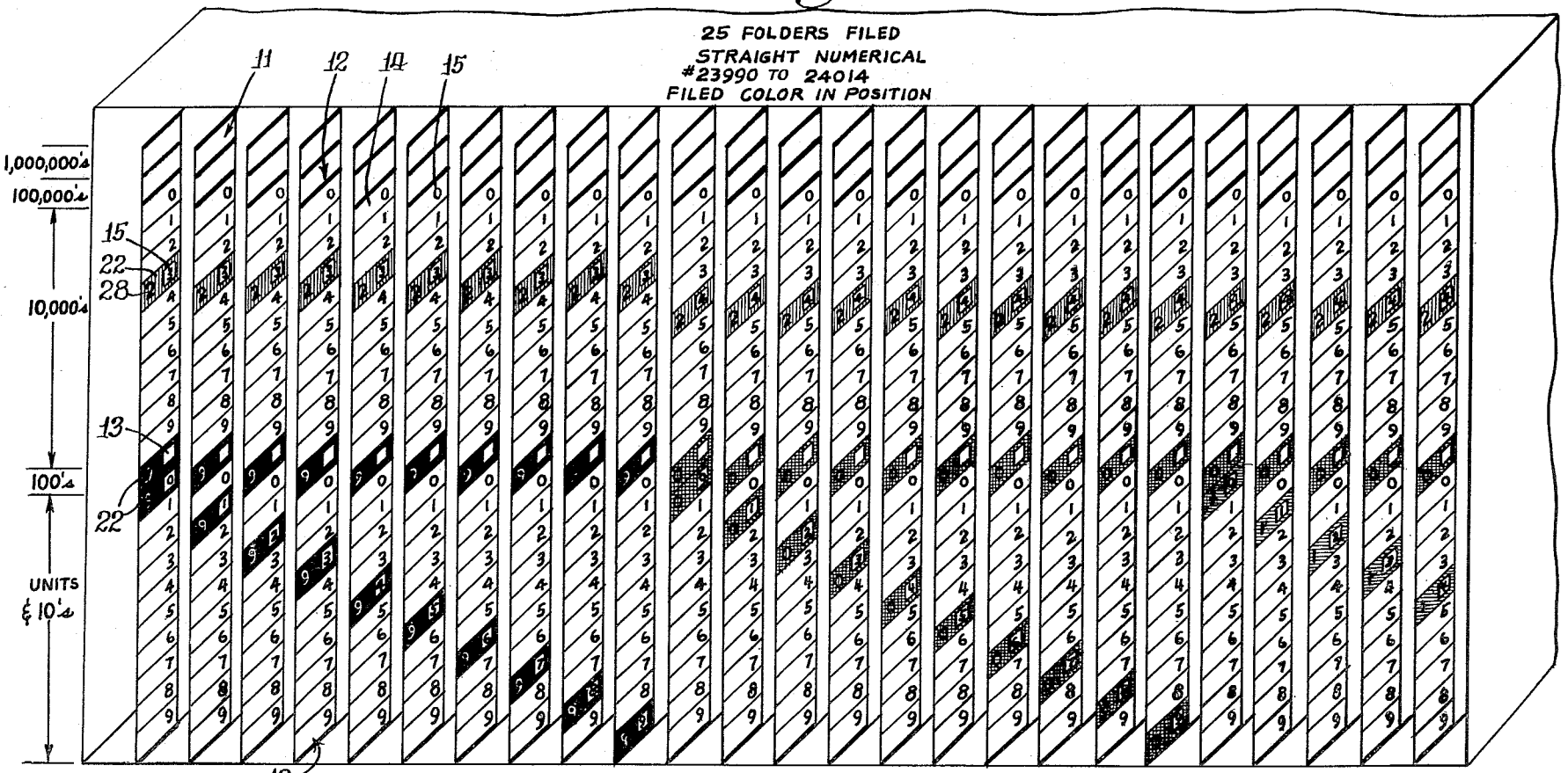
FIG. 1 is a perspective view of a portion of a file of folders employing the color coded indexing system of this invention in straight numerical arrangement.

Referring more particularly to FIG. 1, a plurality of documents, each indicated generally by reference numeral 11 and in this embodiment comprising a standard plain manila folder, are shown filed vertically in straight numerical arrangement, this illustrated portion of the file including 25 folders numbered, respectively, from 23,990 to 24,014. One edge portion of each folder 11 displays two ten-position digital bars 12 printed thereon which are spaced longitudinally from each other at 13 and each of which is divided into ten positions or divisions 14 successively carrying the numerals 0–9 from top to bottom which are identified herein by reference numeral 15.

Figure 4:
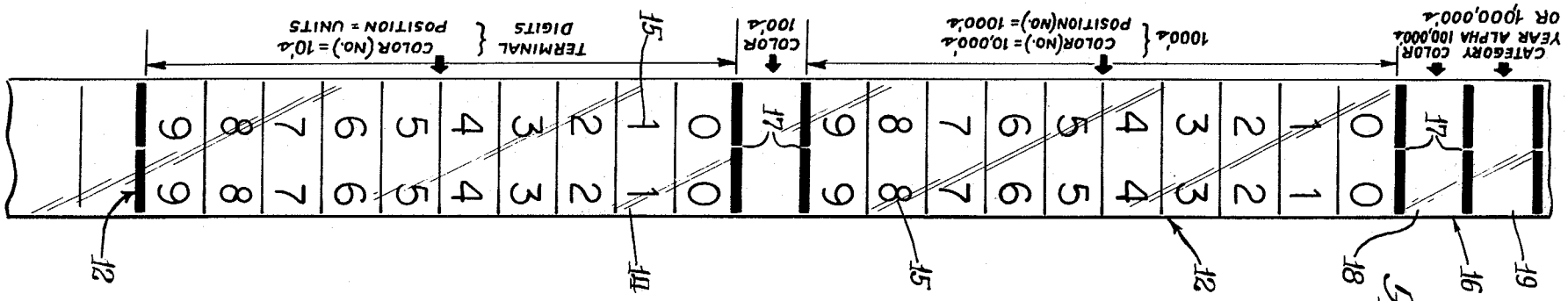
FIG. 4 is a plan view of a digital bar strip for mounting or printing before folding on an edge of a document.

The digital bars 12 preferably are printed on each of the two opposed surfaces of the edge portion of each document 11, those shown in FIG. 1 being on the reverse surfaces, and the relationship of the opposed bars is illustrated in FIG. 4 which is a layout of all four bars 12 on a document 11. Actually, FIG. 4 shows a separate strip 16 intended to be applied or adhered to an edge portion of any existing document, such as a folder, file, card, or the like, to adapt it for use in the present color coded indexing system. To this end, the longitudinal center line of the strip 16 is located by gaps 17 in the lines defining the ends of the bars 12, and in applying a strip 16 to an edge of a document 11, the strip center line defined by the gaps 17 will coincide with the edge of the document and the strip will be folded over on its center line to adhere its lefthand half on the obverse surface and its righthand half on the reverse surface of the document. As will be evident from FIG. 4, the numerals 15 on the two bars 12 on the left side are in a column directly adjacent the center line of the strip 16 so that they will be directly adjacent the edge of the document, whereas the numerals 15 on the two bars 12 on the right side are spaced or offset from the strip center line to result in their being similarly offset inwardly from the edge of the document, as seen in FIG. 1.

FIG. 4 also illustrates how concise instructions may be included on an adapter strip 16 or document 11 to facilitate use of the color coded tabs, hereinafter to be described, including designation of the ten thousands and thousands digits of the document number on the upper bars 12, the hundreds digit in the space 13, and the tens and units digits on the lower bars 12. Also included are a space 18 above the bars 12 for receiving a color tab designating the hundred thousands digit of a document number and a top space 19 for identifying the document category, year, alpha or millions digit of the document number.

Figure 6:
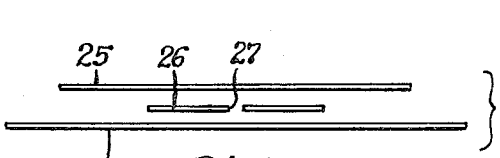
FIG. 6 is an exploded end view of the strip of FIG. 5.
Figure 5:
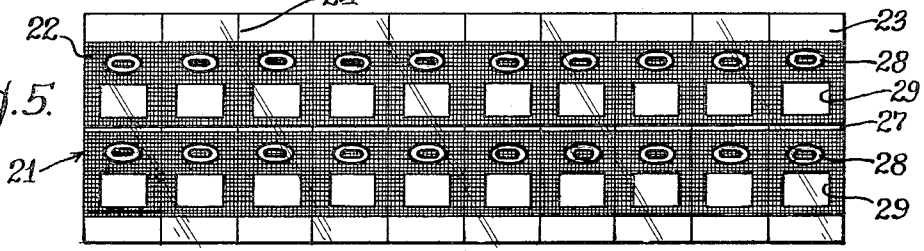
FIG. 5 is a plan view of a strip of separate digit tabs.

FIG. 5 illustrates a set, indicated generally by reference numeral 21, of color coded single digit tabs 22 mounted on a backing strip of release paper 23. The lower surfaces of the tabs 22 are coated with a suitable pressure-sensitive adhesive, the tabs being cut through to the backing strip 23 along the lines 24 transversely of the strip to enable them to be individually separated therefrom. Preferably the tabs 22 are made up from two strips of transparent film, the top strip 25 (FIG. 6) being of a suitable polypropylene or polyester and the bottom laminate being a strip 26 of cellulose acetate which is shown as slit at 27 along its longitudinal center line. Such slit 27 is not essential, but it facilitates folding of the tabs 22 when they are removed from the backing strip 23 and applied to opposed surfaces of a document 11. This arrangement of the plurality of individual tabs on a backing strip of release paper is generally similar to those of my prior U.S. Pat. Nos. 2,893,144 and 3,805,426. However, a single ply of transparent film may be printed or silk screened and used in like manner.

The critical and important differences between those prior strips and the instant strips or sets 21, however, are that each tab 22 herein presents a numeral 28 adjacent its outer edge on its left half or obverse side in use (top in FIG. 5) and adjacent its center on its right half or reverse side in use (lower in FIG. 5) and a transparent portion or window 29 aligned with and to the right of each numeral 28. Thus, on each set 21 the numerals 28 on the tabs 22 define two columns of digits, with the righthand column (lower in FIG. 5) closely adjacent the longitudinal center line of the strip, as defined by the slit 27 if that is used, and the lefthand column (top in FIG. 5) offset laterally from that center line.

Consequently, removal of a tab 22 from its backing strip of release paper 23 and adhering it to a document 11 over one of the divisions 14 of one of the digital bars 12 by pressing the lefthand end of the tab against the obverse side of the document, with its center line or slit 27 aligned with the edge of the document, then folding the tab on that center line and pressing the righthand end of the tab against the reverse side of the document, will position the transparent portions or windows 29 of the tab over the selected numerals 15 on each side of the document. The single digit tab with only its numerals 28 thus becomes a double digit tab, and the same double digit is displayed at the selected digital position on both sides of the document.

Figure 7:
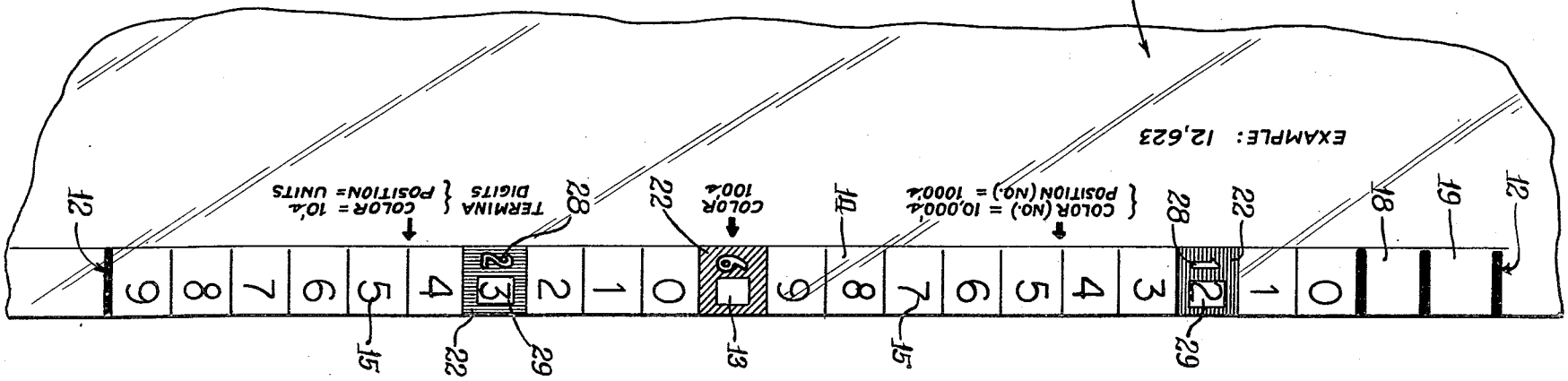
FIG. 7 is a plan view of a right front bar edge portion of a printed document showing the application of three tabs identifying the document number as 12,623.

It now will be better appreciated why only ten different sets 21 of a single digit tabs 22 enable selective display of double digits without requiring 100 different double digit tabs for effecting the same results. As previously noted, not more than three color coded single digit tabs 22 are required to properly register and display on any document 11 any document number up to 99,999 with no two displays or arrangements being alike. To this end, a tab 22 is applied to the lower digital bar 12 of the document 11 to display the terminal digits of the document number, another tab 22 is applied in the space 13 between the bars 12 to indicate the hundreds digit, and a third tab 22 may be mounted on the upper digital bar 12 to display the thousands and ten thousands digits. In FIG. 7 this is illustrated by the three tabs 22 displaying the document number 12,623.

Figure 2:
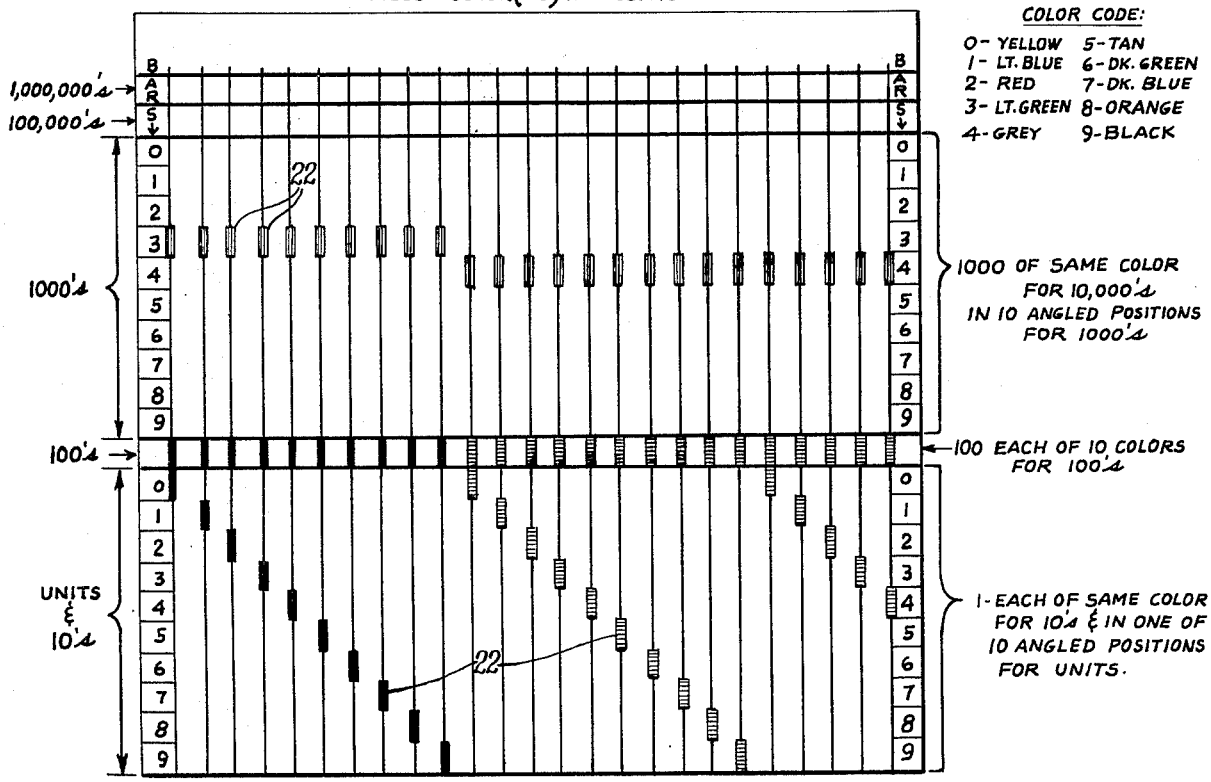
FIG. 2 is a schematic front elevation of that portion of the file of FIG. 1.
Figure 3:
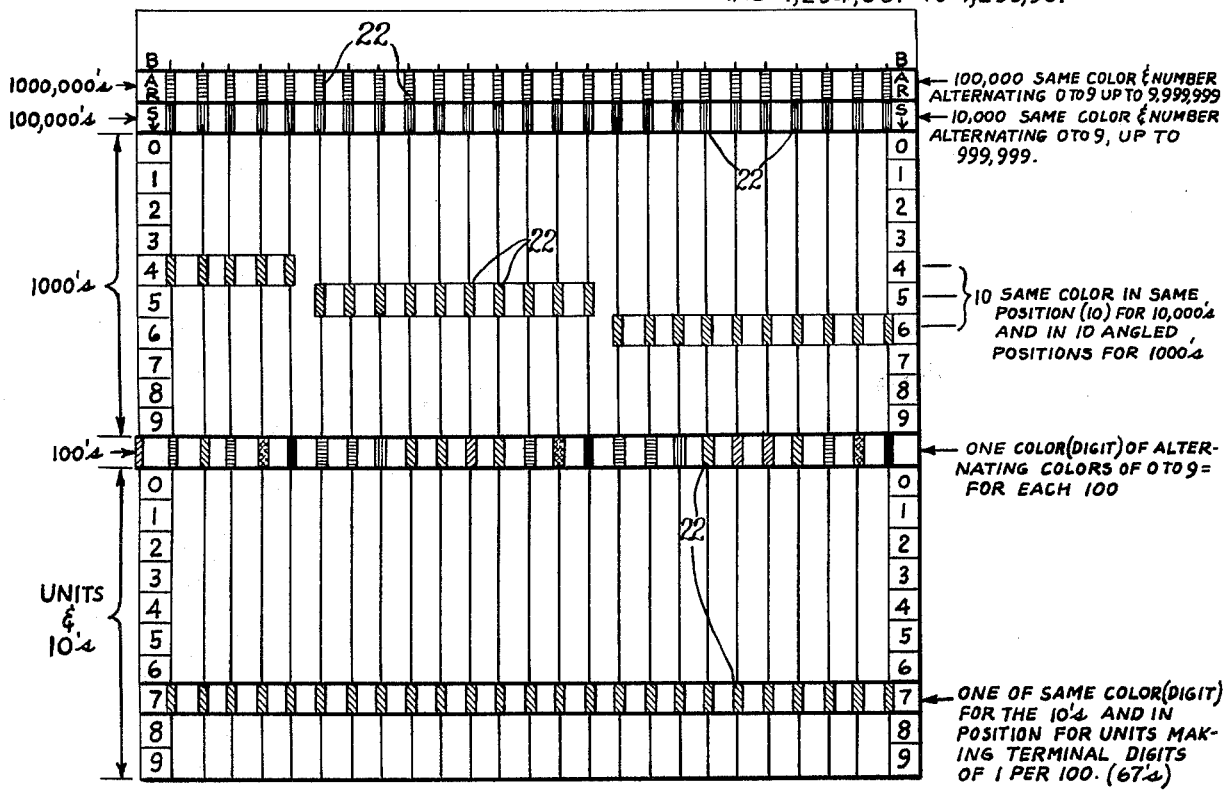
FIG. 3 is a view like FIG. 2 of a portion of a file of documents filed according to their terminal digits, capability to 9 million.

As noted, each of the 10 sets 21 displays one of the digits 0–9 and is coded with a different color. The color code employed, which also is shown in FIG. 2, is:

0 — yellow
1 — light blue
2 — red
3 — light green
4 — gray
5 — tan
6 — dark green
7 — dark blue
8 — orange
9 — black The appropriate color preferably is printed on the sets of tabs 22 to outline the numerals 28 and windows 29 as shown in FIG. 5. If transparent ink is employed, the windows 29 will not be necessary. Or the numerals 28 may be printed separately, such as in black to match the numerals 15 on the document, with the color stripe printed or placed over the center fold. The important features of the tabs 22 are their display of a color corresponding to their particular digits and provision of transparent portions adjacent the latter which in use will be superposed over the selected numerals 15 on the document, the central portion of each color tab applied to a document being displayed along the edge of the document, as best seen in FIGS. 2 and 3. All colors and numbers can also be printed directly on the top or back of a single ply of transparent pressure sensitive film.

Any document with the digital bars 12 printed thereon as previously described, or having a digital bar strip 16 like that shown in FIG. 4 secured along an edge thereof, may have a color coding unique to its particular document number merely by proper attachment of selected tabs 22 thereto. A first tab 22 is selected which displays the numeral 28 comprising the ten thousands digit of the document number. That tab is removed or peeled from its release paper backing strip 23 and applied to the document 11 over that division 14 of the upper bar 12 which displays the numeral corresponding to the thousands digit of the document number. With the example of document number 12,623 of FIG. 7, this first digit tab 22 is colored blue, displays "1", and is placed over the division of the upper bar 12 bearing the numeral "2". A second tab 22 displaying the hundreds digit of the document number, which is "6" in the example of FIG. 7, then is attached to the document in the space 13 between the bars 12, that tab being dark green in color. A third tab 22 which displays the numeral comprising the tens digit of the document number "2" in this example and which is red in color, then is placed over that division of the lower bar 12 which displays the units digit, i.e., "3⇄ in this case.

It will be appreciated that a color coded tab 22 may be placed over the space 18 above the upper bar 12 which displays the hundred thousands digit of a document number if the document numbers go that high, and that the top space 19 similarly may be used to display the millions digit of the document number. Or the space 19 or that below the lower digital bar 12 may be used to indicate other pertinent data, such as category, year, month, day, admission number, or the like. It also will be understood that more than two longitudinally spaced digital bars 12 may be employed to accommodate even larger document numbers, and that the instant color coded indexing may be used in any desired filing system.

When used in a straight numerical system as illustrated in FIGS. 1 and 2, proper filing of the documents having their respective numbers displayed as previously described establishes a color coded set position pattern. The units and tens provide a perfect step pattern of color in ten graduated positions; the hundreds define a straight line of the same color for each successive hundred; and the thousands provide successive straight line groups in ten graduated positions, with the colors thereof determined by the ten thousands. Such pattern greatly simplifies the filing and retrieval of the documents without the use of auxiliary file guides, and any misfile will be immediately apparent from even a casual glance at the file.

FIG. 3 illustrates the use of the instant color coded indexing in a terminal digit filing system, i.e., where all documents having the same terminal digits in their numbers are filed in the same section. As shown in the schematic of FIG. 3 of 25 documents numbered from 1,234,567 to 1,236,967 so filed, the lowest tabs 22 form a straight line of the same color. The particular color is determined by the tens digit and the units digit determines the vertical position of that straight line. The hundreds tabs 22, which are in the spaces 13 between digital bars 12 on the documents (FIG. 7), determine the proper individual positioning of the documents in groups of ten in FIG. 3, with each group of successively different colors; and the thousands tabs define a straight line for each such group, with those group lines in successively vertically graduated positions and of a color determined by the ten thousands digits. In the example of FIG. 3, the uppermost tabs 22 are blue to indicate that the millions digits are "1", while the next lower tabs 22 (each mounted in a space 18 of FIG. 7) are red to indicate that the hundred thousands digits are "2". The third from the top groups of tabs 22 are all light green to indicate that the tens thousands digits are "3", and those tabs are mounted on the upper digital bar 12 (FIG. 7) in those divisions 14 according to the thousands units, being "4", "5" and "6" in the example of FIG. 3.

Consequently, a uniform color and tab position set pattern is displayed in the terminal digits file also, with the upper and lower tabs in straight lines in each section, the hundreds tabs in a straight line central position and in a set color succession in each group, the groups and their color being determined by the ten thousands digits. These groups of thousands tabs are successively separated vertically in accordance with the thousand digits of the document numbers. Again, the pattern thus resulting from proper filing makes the filing and retrieval of documents easy without the use of any auxiliary file guides, and any misfile will break the color coded set position pattern so as to be apparent immediately. While the illustrations of the invention herein show applications of digital bars and color coded single digit tabs to vertically disposed edges of documents, it will be appreciated that they can just as easily be applied to horizontally disposed edges of documents, such as the upper edges of cards with the tab digits above the numerals on the digital bars.

The embodiments of the invention in which an exclusive property or privilege is claimed are defined as follows:

1. A color coded indexing system to facilitate filing and retrieval of documents, comprising two ten-position digital bars spaced longitudinally from each other on and adjacent an edge of each document and each successively displaying in its 10 positions the numerals 0–9, 10 sets of color coded single digit tabs with each set displaying one of the numerals 0–9 and having a different color and each said tab having a transparent portion adjacent to and aligned with the said numeral thereon, and means for adhering selected said tabs to a document over said bars, whereby said transparent portion of a said tab adhered to a document over a said bar in any digital position thereof will overlie the digit in that position to transform said single digit tab into a double digit tab to provide a proper identification of the particular number of said document and proper filing of documents so identified will establish a color coded set position pattern for any desired filing system.

2. A color coded indexing system according to claim 1, wherein the colors of any said tabs adhered to said document over said bars identify the ten thousands and tens digits of the number of said document, the color of a said tab adhered to said document in the space between said bars identifies the hundreds digit of said document number, and the digital positions of said tabs over said bars identify the thousands and units digits of said document number.

3. A color coded indexing system according to claim 1, wherein the resulting said double digit tab on the first of said two bars displays the units and tens digits of said document number, and the hundreds digit of said document number will be displayed by a said single digit tab adhered to said document in the space between said bars.

4. A color coded indexing system according to claim 3, wherein the thousands and ten thousands digits of said document number will be displayed by a said double digit tab adhered to said document in the appropriate digital position on the second of said two bars.

5. A color coded indexing system according to claim 4, wherein the colors of said tabs adhered to said document over the said second bar, the said space between said bars, and the said first bar identify, respectively, the ten thousands, hundreds and tens digits of the number of said document, and the digital positions of said tabs over said second and first bars identify, respectively, the thousands and units digits of said document number.

6. A color coded indexing system according to claim 1, wherein said two ten-position digital bars comprise a separate strip having said bars printed thereon for mounting on an edge portion of a document to facilitate use in said system of documents on hand originally intended for other uses.

7. A color coded indexing system according to claim 1, wherein said transparent portion of each said color coded single digit tab comprises a window spaced laterally from said numeral thereon so as to overlie the selected digit on a said digital bar when said tab is adhered to said document to convert said single digit tab in use to a double digit tab.

8. A color coded indexing system according to claim 1, wherein said transparent portion of at least some of said sets of color coded single digit tabs is formed by printing the same with transparent ink.

9. A color coded indexing system to facilitate filing and retrieval of documents, comprising two ten-position digital bars spaced longitudinally from each other on each opposed surface of an edge portion of each document and each successively displaying in its 10 positions the numerals 0–9, with said numerals on the obverse said surface closely adjacent the edge of said document and those on the reverse said surface offset inwardly from said edge; 10 sets of color coded single digit tabs with each set having a different color, a longitudinal center line defining the center lines of said tabs, and displaying one of the digits 0–9 in columns on opposite sides of said longitudinal center lines, with said digits in the righthand said column closely adjacent said center lines and those in the lefthand said column offset laterally from said center lines, and transparent portions to the right of each said digit; and means for adhering a selected said tab to a document, whereby positioning the lefthand end thereof over a said bar on said obverse surface in any selected digital position thereof with said center line of said tab aligned with said edge of said document and adhering said lefthand end of said tab to said obverse surface, folding said tab on said center line and adhering the righthand end of said tab to said reverse surface of said document will position said transparent portions of said tab over said numerals on each side of said document to present the same double digit display at the selected digital position on both sides of said document.

10. A color coded indexing system according to claim 9, wherein each said set of single digit tabs comprises a backing strip of release paper, and a strip of transparent film having a coating of pressure-sensitive adhesive on one surface thereof mounted on said backing strip and transversely cut through to said backing strip to provide a plurality of individually separable tabs, with each said tab displaying a said digit by printing on said strip and a said transparent portion being disposed laterally adjacent said digit.

* * * * *